US005967306A

United States Patent [19]

Umiker

[11] Patent Number: 5,967,306

[45] Date of Patent: Oct. 19, 1999

[54] STACKABLE BOTTLE CASE

[76] Inventor: Hans Umiker, Brunnenwiese 31, 8132 Egg/ZH, Switzerland

[21] Appl. No.: 08/974,596

[22] Filed: Nov. 19, 1997

[30] Foreign Application Priority Data

Sep. 9, 1997 [DE] Germany ..... 197 39 484

[51] Int. Cl.[6] ..... B65D 75/00; B65D 21/00

[52] U.S. Cl. ..... 206/203; 206/201; 206/503; 206/519

[58] Field of Search ..... D3/311, 312, 313, D3/314; 206/427, 503, 509, 511, 201, 203; 220/516, 519

[56] References Cited

U.S. PATENT DOCUMENTS

| | | | |
|---|---|---|---|
| D. 379,121 | 5/1997 | Apps et al. | D3/314 X |
| D. 379,717 | 6/1997 | Apps et al. | D3/311 |
| 4,773,554 | 9/1988 | Warwick | 206/503 X |
| 4,899,874 | 2/1990 | Apps et al. | 206/201 |
| 4,978,002 | 12/1990 | Apps et al. | 206/201 |
| 5,060,819 | 10/1991 | Apps | 220/519 |
| 5,501,352 | 3/1996 | Apps | 206/203 X |
| 5,529,176 | 6/1996 | Apps et al. | 206/201 |
| 5,651,461 | 7/1997 | Apps et al. | 206/503 |

OTHER PUBLICATIONS

Copy of Labeled Figure 1 From D379717.

*Primary Examiner*—Bryon P. Gehman

*Attorney, Agent, or Firm*—Van Dyke, Gardner, Linn & Burkhart, LLP

[57] ABSTRACT

A stackable bottle case includes side surfaces divided into side walls running around the bottom and supporting pillars protruding upward beyond the side walls, and a bottom for receiving the bottles. The supporting pillars in the area of the case sides extend with their outside surfaces in essentially directly flush continuation of the side wall outside surface from there upward and on a slightly inward slant. This results not only in a compact exterior but also in smooth outside surfaces of the side surfaces which firstly avoid a danger of injury during handling of the cases and secondly permit easy cleaning of the bottle case. The slight inward slant of these pillars permits uncomplicated engagement of the stacked bottle cases when they contain no bottles. In addition, this inward slant permits fast stacking because when a bottle case is placed above it is automatically centered on the bottle case below by the inward slanting pillars on all sides and then mounted in centered fashion. It is thus unnecessary to slide the bottle case above back and forth several times for fixing this bottle case on the bottle case below.

21 Claims, 6 Drawing Sheets

STACKABLE BOTTLE CASE

TECHNICAL FIELD AND BACKGROUND OF THE INVENTION

This invention relates to a stackable bottle case according to the preamble of claim 1.

Bottle cases are known in different constructions up to now. These bottle cases have in common a formation of side walls, bottom areas for receiving bottles and some device for promoting stacking of the cases. For example, European patent EP 838 383 has upwardly protruding pillars disposed at the sides and in the middle between the bottles to be received in the bottom area of the bottle case thereabove. However, the vertical arrangement of these pillars and the strictly vertical walls thereof, and the groove thereof disposed partly on the pillars for better stacking make it necessary to push the bottle cases placed above back and forth several times to permit different bottle cases to lock in or be stacked. In addition, the bottles are disposed with superfluous spaces therebetween due to the form of the bottle case altogether and in particular the individual pillars.

In addition, the bottle case according to this European patent is not produced in keeping with the requirements of saving material and space, i.e. is not optimized.

When the bottle cases are full, the individual stacked bottle cases rest on the bottle heads of the bottles therebelow with the underside of the bottom, a small central step being intended to permit better locking of the bottle case above. However, during long transports this causes the cap of each bottle to be considerably loaded, which can cause gas to escape from the bottle. It should be considered that the caps are often curved upward under pressure.

Therefore it is the problem of the invention to provide a stackable bottle case which permits simple and fast stacking and fixing of the stacked bottle cases, a space-saving arrangement of several bottle cases, and fast and simplified production thereof.

SUMMARY OF THE INVENTION

This problem is solved according to the features of the characterizing parts of claims 1 and 2, expedient developments being characterized by the features contained in the subclaims.

The invention is characterized mainly in that a stackable bottle case with side surfaces divided into side walls running around the bottom and supporting pillars protruding upward beyond the side walls, and a bottom for receiving the bottles, comprises supporting pillars in the area of the case sides which extend with their outside surfaces in essentially directly flush continuation of the side wall outside surface from there upward and on a slightly inward slant.

This results not only in a compact exterior but also in smooth outside surfaces of the side surfaces which firstly avoid a danger of injury during handling of the cases and secondly permit easy cleaning of the bottle case.

The slight inward slant of these pillars permits uncomplicated engagement of the stacked bottle cases when they contain no bottles. In addition, this inward slant permits fast stacking because when a bottle case is placed above it is automatically centered on the bottle case below by the inward slanting pillars on all sides and then mounted in centered fashion. It is thus unnecessary to slide the bottle case above back and forth several times for fixing this bottle case on the bottle case below.

The stackable bottle case, which is preferably made of plastic, can comprise these inward running supporting pillars shaped as tapered supporting pillars, i.e. each supporting pillar is centered running upward. This permits fast, uncomplicated and centered stacking of the individual bottle cases.

The inward slanting pillars in conjunction with a very low side wall in comparison to the bottle disposed therein ensures a fast, material-saving and cost-saving production method, and results in a compact exterior of this bottle case in conjunction with good stiffness. The low side walls can be formed with a greater height in the load-critical areas of the case, preferably in the area of the case comers, in order to ensure an additional increase in stiffness.

Stable stacking of bottle cases is facilitated in addition by the bottom area on the underside of each bottle case which is formed for receiving the bottle caps of the cases stacked below. This one- or multistepped bottom area into which the bottle caps of the case stacked below easily fit serves to align the bottle case above with the bottle caps below, which is improved by a bulge and an opening in the center of each receiving place for a bottle cap. This bulge prevents pressure on the soft part of the cap to stop gas (e.g. the carbonic acid) from escaping from the bottle during any transport-related vibrations and shocks. Further, an opening is provided in the center of each supported bottom receiving area for further promoting the advantage of the bulge. The slopes disposed on the individual steps of the bottom area serve to laterally stabilize the bottle case thereabove, facilitate removal of the bottle case thereabove, and to transfer the load as directly as possible to the bottleneck and facilitate centering during automatic palletizing.

The receiving areas for the bottle caps of the cases stacked below disposed in the area below the bottle receiving means in the bottom area are preferably designed so as to permit offset stacking. This makes it possible to dispense with shrink wrapping or hoop winding of the palette in many cases since the stacks are much more stable.

The supporting pillars located in the area of the case sides can preferably be provided optionally with slots for receiving any bottom ribs passing through upon stacking of the different bottle cases and thereby reducing the so-called box height (empties), on the one hand, and to ensure the use of any small packages, on the other hand.

Optimal utilization of space on the palettes is permitted by the bottle cases according to the invention due to the very close arrangement of the individual bottles within the case. With bottle cases according to the prior art, for example, one can dispose at most 80 bottles on one level of a palette, whereas the bottle case of the invention permits up to 120 bottles to be disposed on one level of a palette.

In the following, preferred embodiments of the invention will be described with reference to the drawings.

DETAILED DESCRIPTION OF PREFERRED EMBODIMENTS

Figure 1:
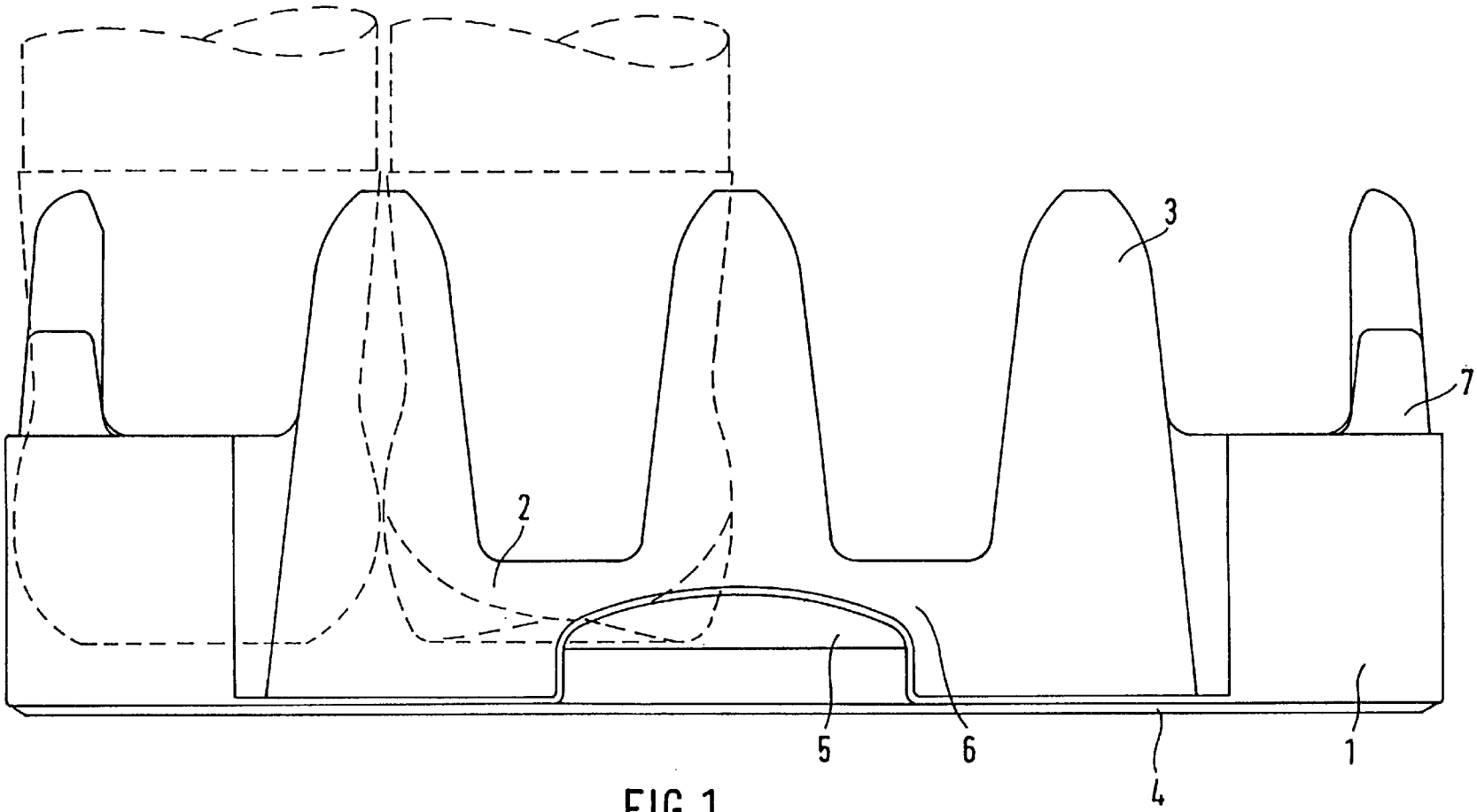
FIG. 1 shows a side view along the longitudinal axis of a stackable bottle case according to the invention.

FIG. 1 shows a stackable bottle case made of plastic having a base, side surfaces 1, which are composed of side walls 2, and a plurality of supporting pillars 3. Side walls 2 run or extend around the base, and supporting pillars 3 protrude upward from the edge side or perimeter of the base and are spaced apart circumferentially around the perimeter of the base. The base includes a bottom portion to receive bottles, which are restricted or limited inside the case by bottle receiving compartments with bottle support surfaces, which are defined by web walls and/or supporting sleeves. Supporting pillars 3 located on the case's sides or perimeter slant upward and slightly inward with the outside surface of the supporting pillars being directly flush in continuation of the side wall outside surface, thereby permitting fast centering of the bottle case above on the bottle case below in the empty state. Fast and uncomplicated stacking of empty bottle cases is thus possible according to the invention.

Figure 2:
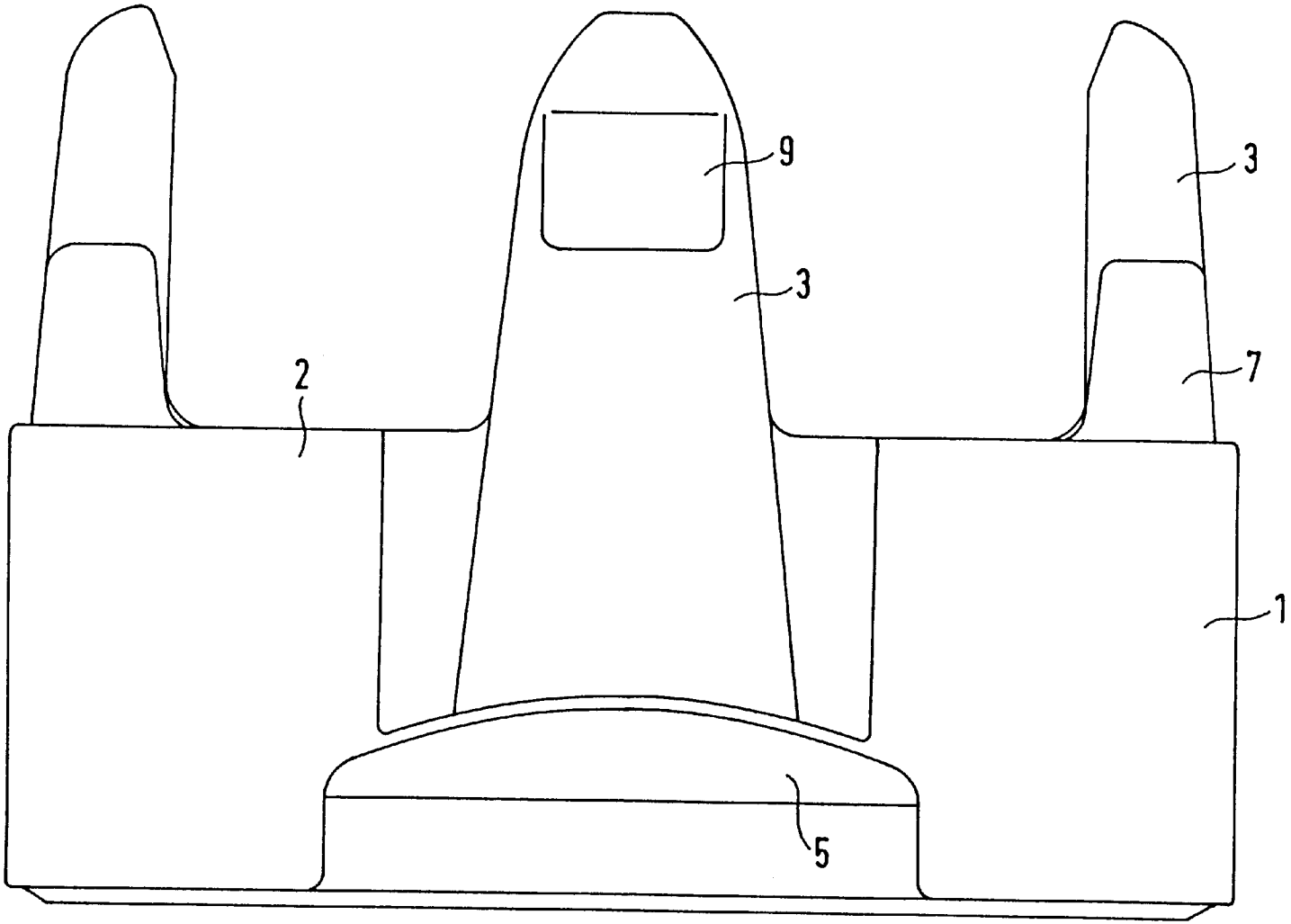
FIG. 2 shows a side view along the transverse axis of the bottle case according to the invention.
Figure 5:
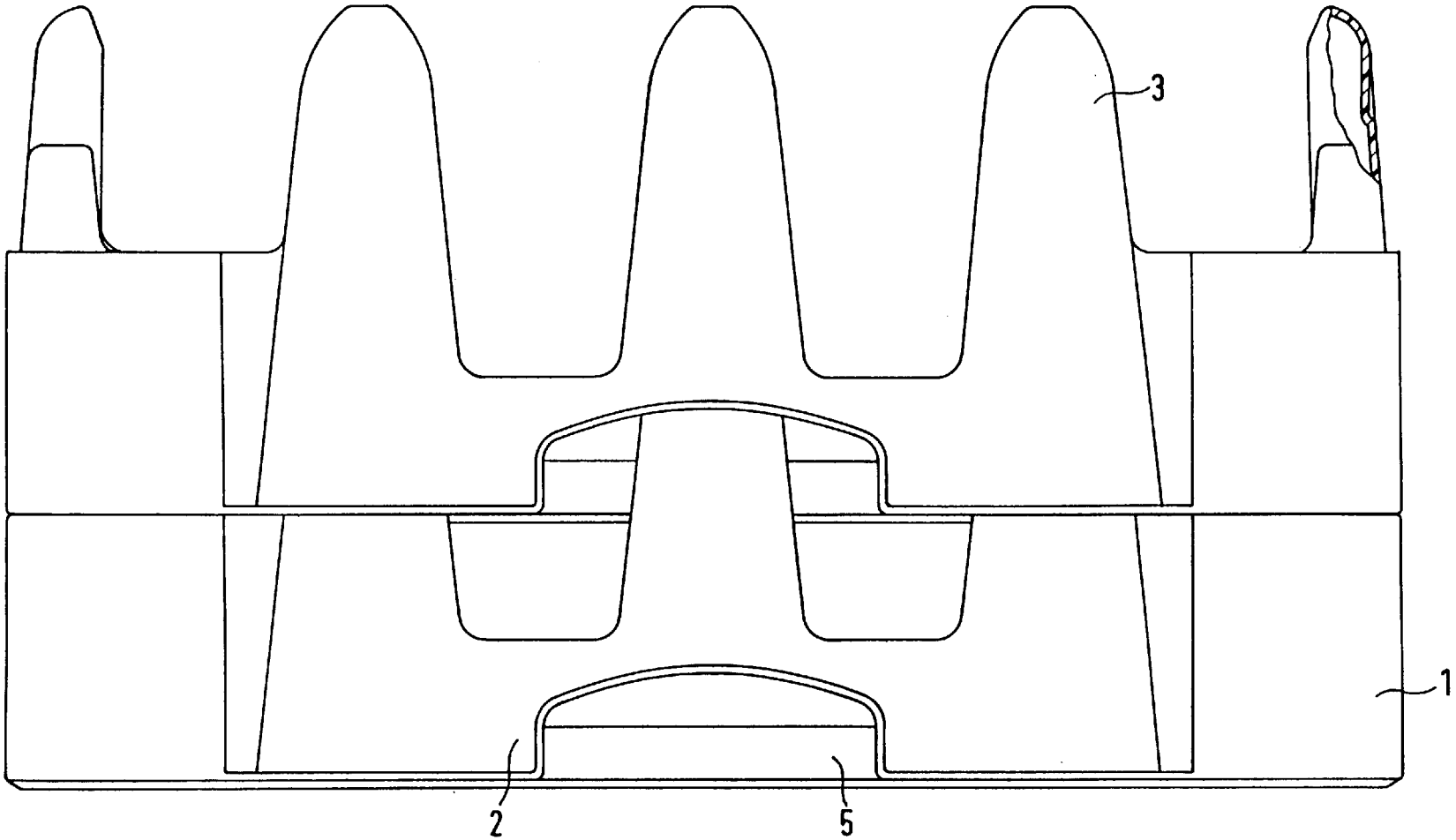
FIG. 5 shows two stackable bottle cases according to the invention in stacked form.

As evident from FIGS. 1, 2 and 5, upwardly protruding supporting pillars 3 are formed in one embodiment as tapered supporting pillars 3. The advantage of this becomes evident from FIG. 5 showing two stacked bottle cases which can be stacked quickly and simply due to the special form of supporting pillars 3.

FIG. 1 likewise indicates the shaping of handle 5 on the two long and two broad sides of the bottle case.

Between supporting pillars 3 side wall 2 is shaped as strip 6 which has a low height, being reduced essentially to strictly a supporting function since supporting pillars 3 on the edge side mainly contribute to holding the bottles, and which extends essentially not beyond the area of the bottom of the bottle placed in the case. Strip 6 is preferably formed with a near-bottom height. However, strip 6 can be shaped higher in the load-critical areas, i.e. in particular the comer areas, in order to ensure increased stiffness or stability of the bottle case in this area. A preferred height of side walls 2 located in these comer areas is half the height of supporting pillars 3, which rise or extend above side walls 2.

Supporting pillars 7 can additionally be shaped in the comer areas, said pillars having a height such that their topmost edge is in a plane with the upper edge of supporting pillars 3. However, it is also within the scope of the invention for comer supporting pillars 7 to have a low height.

FIG. 2 shows a side view along the transverse axis of the bottle case according to the invention, wherein supporting pillars 7 disposed in the case comers are offset inward at a distance of about one side wall thickness for the purpose of case stacking in the empty state. This embodiment thus permits easier and faster stacking of the bottle cases. Supporting pillars 7 can be slanted inward with their outside surfaces like supporting pillars 3. One can also provide a stepless connection of supporting pillars 7 with the side wall like the formation of supporting pillars 3.

Side walls 2 shown in FIGS. 1 and 2 are furthermore formed as single-webbed side walls.

Supporting pillars 3 can optionally be provided with stacking slots (not shown) for receiving bottom ribs passing through the interlocking stack on the cases stacked thereabove, in particular in offset stacking.

With consideration of the shaping of handles 5 in the bottle case above, supporting pillar 3 located directly below handle 5 in the bottle case below can be provided with notches or gaps 9 to permit handle 5 in the bottle case above to be received well by the bottle case below.

Figure 3:
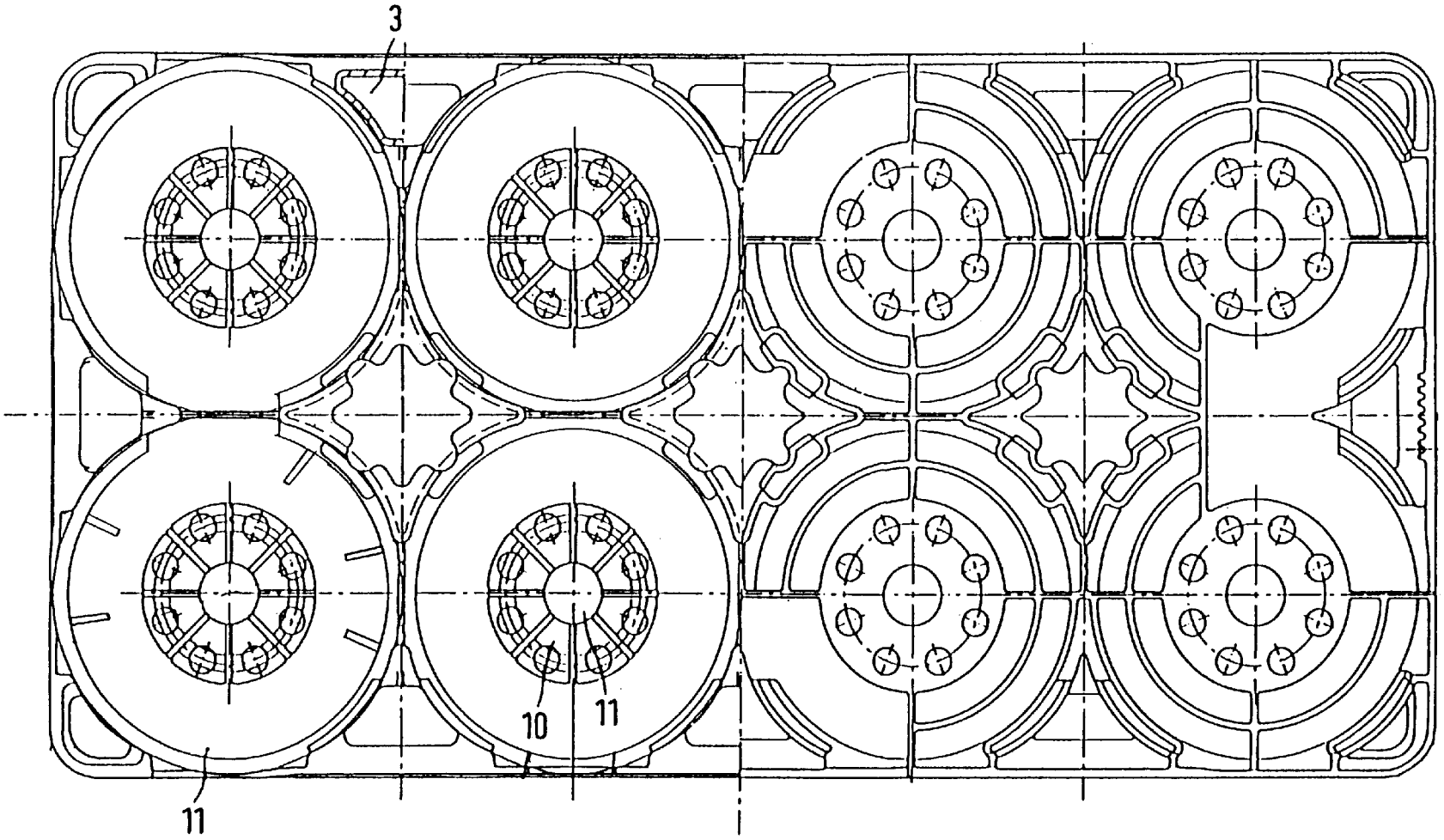
FIG. 3 shows a plan view of the bottle case according to the invention.

FIG. 3 shows a plan view of the bottle case according to the invention. This plan view makes clear that the bottle case according to the invention permits a very space-saving arrangement of bottles, as illustrated by the single-webbed side walls between the individual bottles. This permits a great number of cases to be accommodated on one palette.

The supporting pillars can in addition have steps (not shown) which limit the height in the stacking of different bottle cases in order to prevent the cases from being damaged by excessive compression of the stacked cases.

Figure 4:
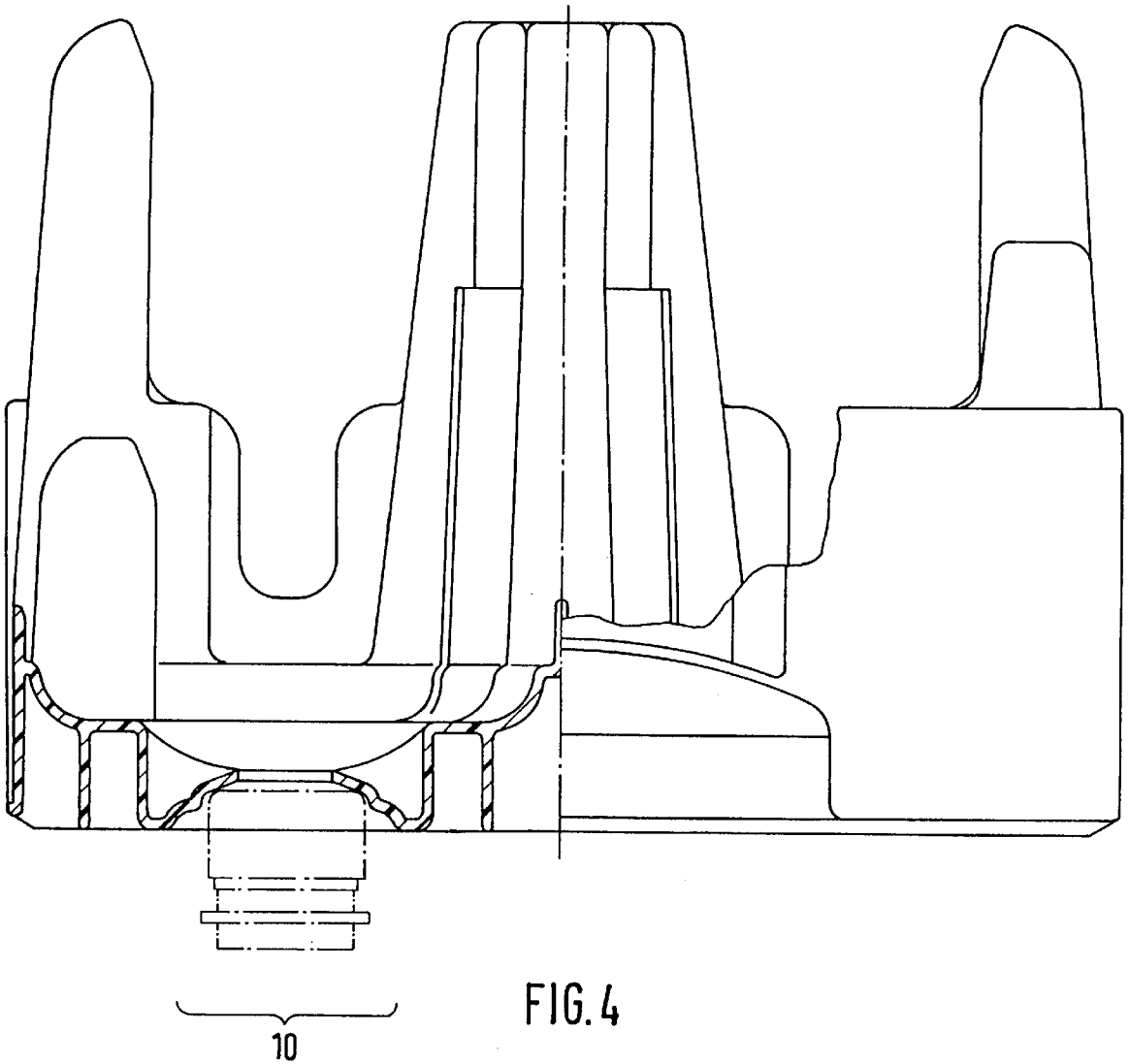
FIG. 4 shows a partial cross section of the bottle case according to the invention.

At the same time, FIG. 3 in conjunction with FIG. 4 make clear that in the bottom area of the bottle case in the area below the bottle receiving means on the underside of the case there are receiving areas 10 having one or more steps, thereby permitting the cap of the bottle therebelow to be received. Areas 10 are aligned with the caps of the bottles therebelow and bulge upward. This prevents the case stacked above from being supported on the middle of the cap and damaging it during transport. Since the stepped areas are connected by slopes, the case stacked above can also be removed quickly and safely. The multistepped design further ensures that different-sized bottle caps can be used for one and the same case.

In addition one can form tabs, bars or tongues 12 protruding from the web walls or sleeve walls inside the case in the comers of the receiving compartments for bottles 11, which are springy and act as retaining springs to prevent the bottles from rotating during transport and thus protect the bottles.

FIG. 5 indicates how two stacked bottle cases engage in the empty state. Supporting pillars 3 located below handle 5 of the bottle case above engage via handle 5 the supporting pillar of the upper bottle case. The other supporting pillars are received in gaps on the underside of the supporting pillars above, which are expediently formed as hollow sections.

Figure 6B:
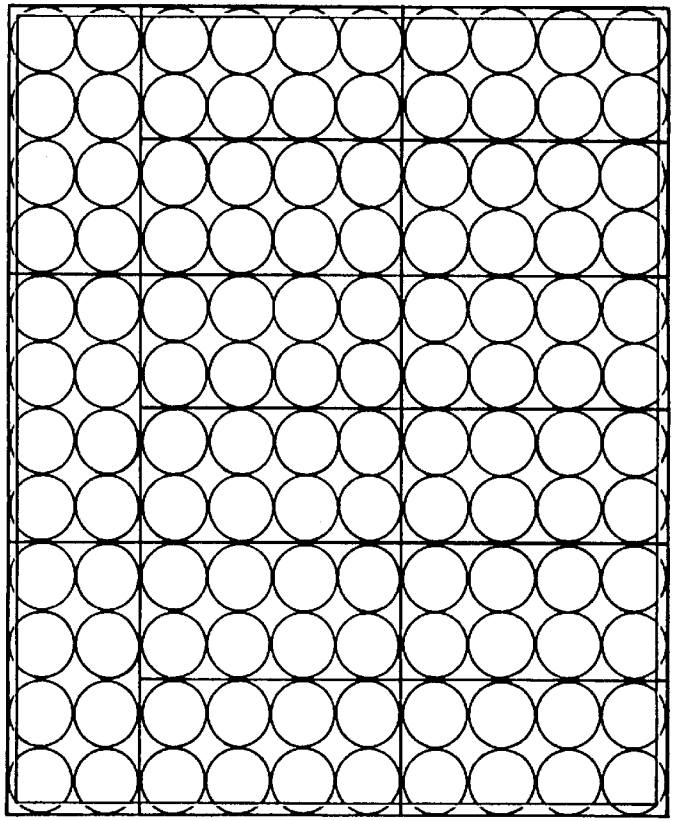
FIG. 6*b* shows another arrangement of a bottle case according to the present invention on one level of a palette.
Figure 6A:
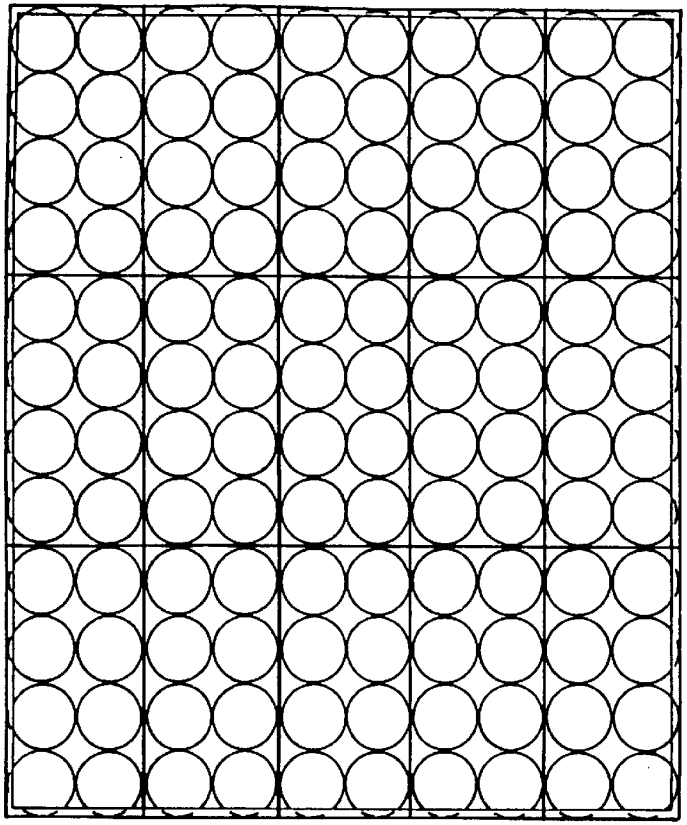
FIG. 6*a* shows one arrangement of several bottle cases according to the invention on one level of a palette.

FIGS. 6*a* and 6*b* show possible arrangements of a plurality of bottle cases on one level of a palette, thus making clear that, in contrast to conventional bottle cases according to the prior art, one can for the first time dispose up to 120 bottles on a pallet level conforming to standards, whose dimensions are given in FIGS. 6*a* and 6*b* merely by way of example.

I claim:

1. A stackable bottle case comprising:

a base having a perimeter and including a plurality of bottle support surfaces said bottle support surfaces for receiving bottles and for restricting movement of the bottles inside said stackable bottle case;

a side wall extending around said base, said side wall including an outerside surface and defining sides of said case;

a first plurality of supporting pillars extending above said side wall and being spaced apart circumferentially along said perimeter, each of said supporting pillars including an outerside surface substantially flush with said outerside surface of said side wall, and said supporting pillars extending upwardly and slanting inwardly from said outerside surface of said side wall; and a second plurality of supporting pillars, said side wall defining corners of said case, said second plurality of pillars being positioned at said comers, said side wall having a first height intermediate said first plurality of supporting pillars and having a second height adjacent both sides of said second plurality of supporting pillars, said second height being greater than said first height to thereby reinforce both sides of said second plurality of supporting pillars.

2. A stackable bottle case according to claim 1, wherein said stackable bottle case comprises plastic.

3. A stackable bottle case according to claim 1, wherein said side wall defines comer areas and has a side wall thickness, said supporting pillars being provided in said corner areas of said case and being offset inwardly from said side wall by about one side wall thickness to permit stacking of a plurality of stackable bottle cases.

4. A stackable bottle case according to claim 3, further comprising a second plurality of supporting pillars, said first plurality of supporting pillars being located along said sides of said case, said second plurality of supporting pillars being located at respective comers of said case and extending upwardly and slanting inwardly from said side wall to permit stacking of said cases.

5. A stackable bottle case according to claim 1, wherein said side wall comprises a single-webbed side wall.

6. A stackable bottle case according to claim 1, wherein said base includes a plurality of sleeves, said sleeves defining receiving compartments for the bottles, and said sleeves being adapted to restrict movement of the bottles inside said case.

7. A stackable bottle case according to claim 6, wherein said supporting pillars extend above said sleeves.

8. A stackable bottle case according to claim 1, further comprising a handle.

9. A stackable bottle case according to claim 8, wherein said handle comprises a pair of recesses, said recesses formed in opposed sides of said case in said side wall.

10. A stackable bottle case according to claim 1, wherein said stackable case comprises a first stackable case, said first stackable case having bottom ribs, at least one of said supporting pillars including stacking slots for receiving bottom ribs of a second stackable case positioned above said first stackable case.

11. A stackable bottle case according to claim 3, wherein said supporting pillars include flexible tongues protruding inward in a direction of said bottle receiving compartments for holding bottles received in said stackable case secure from rotation.

12. A stackable bottle case comprising:

a base having a perimeter and including a plurality of bottle support surfaces, said bottle support surfaces for receiving bottles and for restricting movement of the bottles inside said stackable bottle case;

a side wall extending around said base said side wall including an outerside surface and defining sides of said case;

a first plurality of supporting pillars extending above said side wall and being spaced apart circumferentially along said perimeter, each of said supporting pillars including an outerside surface substantially flush with said outerside surface of said side wall, and said supporting pillars extending upwardly and slanting inwardly from said outerside surface of said side wall; and wherein said stackable bottle case comprises a first stackable bottle case, said base including a downwardly depending portion associated with each of said bottle support surfaces, each of said downwardly depending portions being interconnected by a web, each of said webs defining a cap receiving area for receiving a bottle cap of a bottle in a second stackable bottle case below said first stackable bottle case, each of said cap receiving areas being radially inward of said bottle support surface, and said webs bulging upwardly independent of said bottle support surfaces to minimize pressure on the cap from the bottle case above.

13. A stackable bottle case according to claim 12, wherein each of said webs includes a central opening.

14. A stackable bottle case according to claim 12, wherein each of said webs includes a plurality of sloping sides to accommodate a variety of bottle cap sizes and to permit easier removal of said first stackable bottle case from the second stackable case.

15. A stackable bottle case comprising:

a base having a perimeter and including a plurality of bottle supporting surfaces and a plurality of supporting sleeves defining bottle receiving compartments with said bottle support surfaces, said bottle receiving compartments adapted for receiving bottles and for restricting movement of the bottles inside said stackable bottle case, said base further including downwardly depending portions associated with said bottle supporting surfaces, each of said downwardly depending portions defining a cavity inwardly of a respective bottle supporting surface, and said downwardly depending portion of each cavity being interconnected by a web, each of said webs defining a cap receiving area inwardly of said respective bottle receiving surface;

a side wall extending around said base, said side wall including an outerside surface and defining comers and sides of said case;

a first plurality of supporting pillars extending from said side wall and being positioned in said comers, each of said supporting pillars including an outerside surface substantially flush with said outerside surface of said side wall, and said supporting pillars extending upwardly and slanting inwardly from said outerside surface of said side wall; and a second plurality of supporting pillars extending from said side wall and being positioned along said sides, each of said second plurality of supporting pillars including an outerside surface substantially flush with said outerside surface of said side wall, and said second plurality of supporting pillars extending upwardly and slanting inwardly from said outerside surface of said side wall.

16. A stackable bottle case according to claim 15, wherein said side wall has a first height adjacent both sides of said first plurality supporting pillars and a second height between said second plurality of supporting pillars, said first height being greater than said second height, whereby said side walls adjacent said first plurality of pillars stiffens said first plurality of pillars.

17. A stackable bottle case according to claim 16, wherein said second plurality of supporting pillars has a fourth height, said third height being less than said fourth height.

18. A stackable bottle case according to claim 6, wherein said cavities included stepped portions for receiving a range of bottle cap sizes.

19. A stackable bottle case according to claim 15, wherein said side wall has a side wall thickness, and said supporting pillars being offset inwardly by about one side wall thickness to permit stacking of a plurality of stackable bottle cases.

20. A stackable bottle case according to claim 15, wherein said stackable bottle case comprises a first stackable bottle case, said base including recessed portions extending below said bottle support surfaces, each of said recessed portions including a cavity for receiving a bottle cap of a bottle in a second stackable bottle case below said first stackable bottle case.

21. A stackable bottle case according to claim 15, wherein said stackable bottle case comprises a first stackable bottle case, said side wall including a pair of recessed portions, said recessed portions being disposed on opposed sides of said stackable bottle case and defining handles, at least two supporting pillars being aligned with said recessed portions being notched to accommodate handles of a second stackable bottle case.

* * * * *

UNITED STATES PATENT AND TRADEMARK OFFICE

CERTIFICATE OF CORRECTION

PATENT NO. : 5,967,306
DATED : October 19, 1999
INVENTOR(S) : Hans Umiker

It is certified that error appears in the above-identified patent and that said Letters Patent is hereby corrected as shown below:

Column 4,
Line 48, insert -- , -- before "said bottle support"

Column 5,
Lines 12 and 39, "Claim 3" should be -- Claim 1 --
Line 49, insert -- , -- after "base"

Column 6,
Line 54, "Claim 6" should be -- Claim 16 --

Signed and Sealed this

Eighth Day of February, 2005

JON W. DUDAS
*Director of the United States Patent and Trademark Office*